US008505139B2

(12) United States Patent
Vanhazebrouck et al.

(10) Patent No.: US 8,505,139 B2
(45) Date of Patent: Aug. 13, 2013

(54) ADAPTIVE AUTOMATIC LAUNDRY WASHER WATER FILL

(75) Inventors: Vicente Marconcin Vanhazebrouck, Curitiba-Parana (BR); Marcos Paulo Soares Bittencourt, Sao Jose dos Pinhais-Parana (BR); Marcelo Piekarski, Curitiba-Parana (BR); David Irwin Ellingson, Webster City, IA (US); Jon Roepke, Hermosa Beach, CA (US)

(73) Assignee: Electrolux Home Products, Inc., Charlotte, NC (US)

( * ) Notice: Subject to any disclaimer, the term of this patent is extended or adjusted under 35 U.S.C. 154(b) by 1195 days.

(21) Appl. No.: 11/624,562

(22) Filed: Jan. 18, 2007

(65) Prior Publication Data

US 2008/0172804 A1 Jul. 24, 2008

(51) Int. Cl.
*D06F 35/00* (2006.01)
*D06F 33/00* (2006.01)

(52) U.S. Cl.
USPC ..... 8/159; 8/158; 68/3 R; 68/12.05; 68/12.21

(58) Field of Classification Search
USPC ..... 8/158, 159; 68/12.05, 12.21, 12.22, 68/12.04, 3 R
See application file for complete search history.

(56) References Cited

U.S. PATENT DOCUMENTS 2,782,620 A 2/1957 Roth et al.
4,303,406 A * 12/1981 Ross ..... 8/158
4,480,449 A 11/1984 Getz et al.
4,503,575 A * 3/1985 Knoop et al. ..... 8/158
4,697,293 A * 10/1987 Knoop ..... 8/158
4,835,991 A 6/1989 Knoop et al.
4,982,606 A * 1/1991 Adamski et al. ..... 73/304 C
5,271,116 A 12/1993 Williams et al.
5,408,716 A 4/1995 Dausch et al.
5,439,019 A 8/1995 Quandt et al.
5,768,729 A * 6/1998 Cracraft ..... 8/158
6,029,298 A 2/2000 Dausch et al.
6,151,742 A * 11/2000 Dausch et al. ..... 8/158
6,634,191 B1 * 10/2003 Guler et al. ..... 68/12.04
2003/0097719 A1 * 5/2003 Choi et al. ..... 8/158
2004/0010860 A1 * 1/2004 Johanski et al. ..... 8/158
2004/0187224 A1 * 9/2004 Lueckenbach et al. ..... 8/159
2005/0125909 A1 6/2005 Bellinetto et al.
2005/0166334 A1 8/2005 Clouser

* cited by examiner

*Primary Examiner* — Michael Barr
*Assistant Examiner* — Benjamin L Osterhout
(74) *Attorney, Agent, or Firm* — Banner & Witcoff, Ltd.

(57) ABSTRACT

A washer fill system and method supply a suitable minimum amount of water necessary to wash a particular load of laundry based on readings taken from a pressure sensor that measures liquid pressure in the wash tub. Pressure sensor readings are taken intermittently during the fill process to determine when a sufficient amount of free water for washing the load of clothes has accumulated in the tub. This includes pressure readings taken while pulsing the washer motor to spin the wash basket. Other pressure readings may be taken during a pause in filling to measure the water run-off from the wetted clothes above the free water line, and the release of air bubbles from a load portion below the water line. Determining the sufficiency of the amount of wash liquid in the wash tub involves implementation of an algorithm with coefficients determined through regression analyzes, and may include other factors.

12 Claims, 6 Drawing Sheets

ADAPTIVE AUTOMATIC LAUNDRY WASHER WATER FILL

BACKGROUND OF THE INVENTION

Laundry washing machines conventionally receive a controlled amount of water at the outset of a wash cycle, to saturate the articles of clothing or other laundry placed in a wash basket thereof, and to provide an additional amount of "free water," (i.e., water in the wash tub not absorbed by the clothes) within which the load of laundry may be agitated to induce cleansing during the wash cycle. Typically, the wash basket is a perforated container, rotatably mounted within an outer stationary tub serving to hold the wash liquid. In a conventional arrangement, the water level in the tub is determined by a user-selected load size setting. For example, the user selects from a number of load size settings (e.g., 'Small', 'Medium', or 'Large'), and based on that selection, water is added to the wash tub until a predetermined pressure reading is reached, corresponding to the user-selected load size, whereupon the washer fill is terminated and the next wash cycle (e.g., agitation) commences.

Certain shortcomings are inherent in this conventional technique. Namely, the user-selected load size might not correspond to the actual size of the load of clothes in the wash basket. For instance, a user selecting a large load size for washing just a few clothing items will unnecessarily waste both water, and energy used to heat the water, during the wash cycle. Similarly, a user selecting too small a load size for the clothing load may not supply enough free water to the wash tub for optimal cleansing of the clothes during the wash cycle.

Previous attempts have been made to improve upon the above-described conventional technique for filling a wash tub. U.S. Pat. No. 5,408,716 to Dausch et al. describes a technique which involves measuring pressure surges and cavitations at a sensor positioned beneath the tub, and filling the tub until cavitation substantially decreases. This decrease in cavitation is interpreted as an indication that the tub contains an adequate amount of water for washing the load.

Another technique for filling a wash tub is described in U.S. Pat. No. 4,697,293 to Knoop. This technique involves monitoring the water level during an initial tub fill with a pressure sensor to reach a predetermined minimum water level. A low speed agitation is then engaged using a vertically oriented agitator inside the wash basket, while pressure readings continue to be recorded. The pressure oscillation ranges are used to estimate the load size, then the tub is filled with additional water as needed to reach the predetermined optimum water level based on the estimated load size and user-selected fabric type.

U.S. Pat. No. 4,835,991 to Knoop et al. discloses a technique similar to the earlier Knoop patent for controlling the water fill level. In this technique, a maximum rollover rate of the clothes is determined based on the oscillation range of pressure readings during agitation, and the water fill level is controlled accordingly.

Despite the previous attempts to improve upon the conventional wash tub filling process, there remains a need for a wash tub filling process that can efficiently and accurately regulate the amount of water dispensed into the wash tub based on the load size.

SUMMARY OF THE INVENTION

According to a first aspect of the invention, a motor pulse may be used to momentarily spin a wash basket inside of a wash tub partially filled with wash liquid (e.g. water). Liquid pressure readings may be taken during and shortly after the motor pulse. Based on these pressure readings, a determination is made whether there is a sufficient amount of free water in the tub for washing the laundry load. Iterative cycles of dispensing water into the tub, stopping the fill, pulsing the tub spin motor, and taking pressure readings, may continue until a controller determines that the wash tub contains an appropriate amount of free water for the load, whereupon the fill process may be terminated and the next phase of the wash cycle may commence.

According to another aspect of the present invention, additional pressure readings are performed during the fill process. For example, a time interval may occur during which the water filling process is momentarily stopped, and during which multiple pressure readings may be taken. During this interval, water from the wetted clothes above the free water line may drip or run-off into the pool of free water accumulated in the tub. Additionally, trapped air bubbles in the load may rise to the surface. Thus, the pressure readings may record an increase or decrease in the free water level in the tub during the interval, depending on the load size and type, the water level, and the amount of wetted clothes above the water line. Pressure readings may also be taken to measure the change in water pressure during a momentary interval during which a drainage pump provided in the wash tub drainage line is turned on. These and other measurements, such as the flow rate of water into the tub, user-selected water temperature, and user-selected wash cycle, may be used in determining whether the wash tub contains a sufficient amount of free water for washing the clothes.

In another embodiment, a wash tub fill time may be calculated for adding water from a water supply into the wash tub. The fill time calculation may be based on a load size determination as described above, as well as one or more flow rate determinations taken during various stages of the water fill process. For example, an initial flow rate may be determined during an initial stage of the fill process, followed by an updated flow rate determined after the load size determination. The updated flow rate may allow for a more accurate wash tub fill time calculation, so that when water is added to the wash tub for a duration of time equal to the wash tub fill time, the tub will be filled with a sufficient amount of water for the load size.

The above and other objects, features and advantages of the present invention will be readily apparent and fully understood from the following detailed description of preferred embodiments, taken in connection with the appended drawings.

DETAILED DESCRIPTION OF PREFERRED EMBODIMENTS

Figure 1:
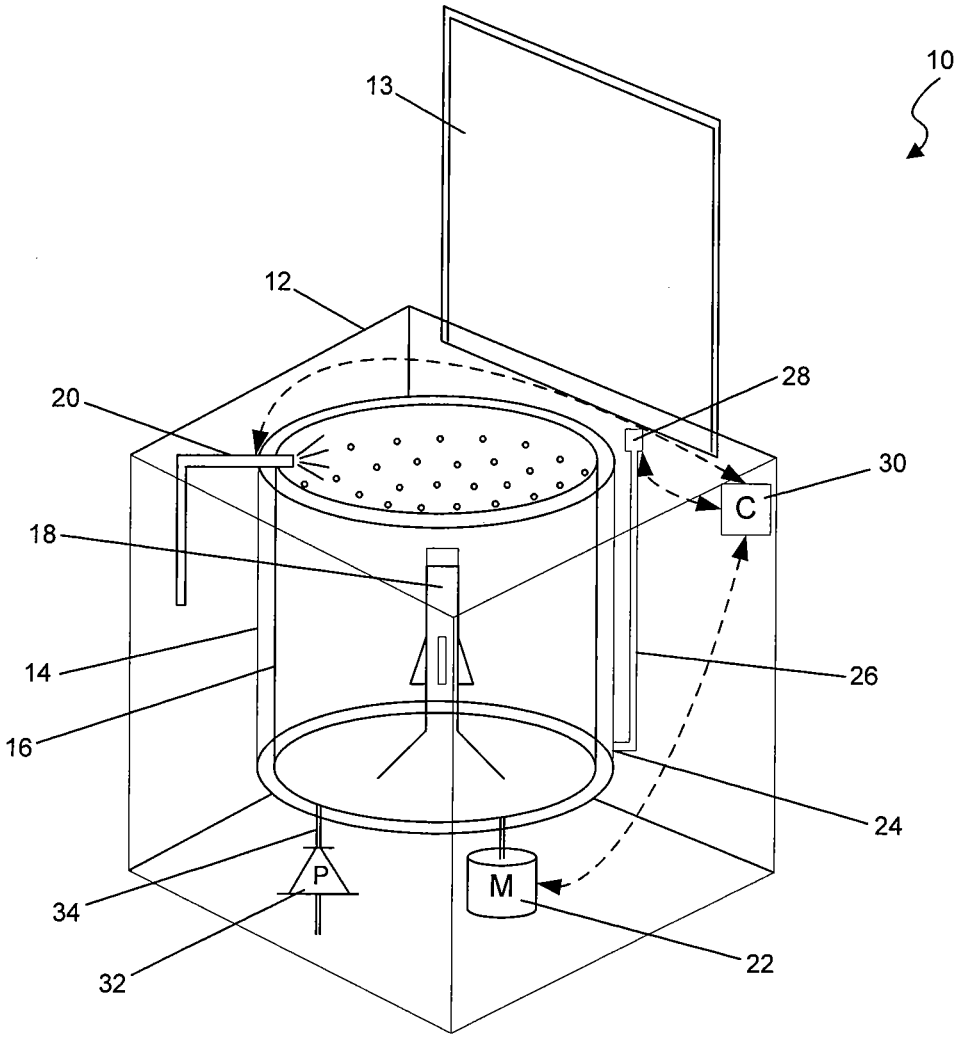
FIG. 1 is a diagrammatic perspective view of an automatic washing machine constructed in accordance with certain aspects of the invention.

With reference to FIG. 1, an illustrative automatic washing machine 10 is diagrammatically shown. Washing machine 10 is a top-loading automatic laundry washing machine including a cabinet or housing 12, and a pivotably openable lid 13. It should be noted that the invention is not limited to such an apparatus but is compatible with many other types of washing machines. A stationary outer imperforate splash tub 14, or wash tub, surrounds an inner perforated rotatable wash basket 16. A vertically oriented agitator 18 is centrally mounted inside the wash basket 16 and is independently rotatable in a known fashion, to agitate the laundry and thereby induce additional wash action during the wash cycle. A water supply 20 provides water to the wash tub 14 and wash basket 16, and a drainage pump 32 provided in a wash tub drainage line 34 extending from the bottom of the wash tub 14, to drain the wash liquid as needed during the wash and rinse cycles. The water supply may include multiple water hoses (e.g., hot and cold) and flow control valves to provide an appropriate water temperature for the selected wash cycle. As used herein, the term "wash liquid" generally encompasses water by itself, water-based detergent, soap and rinse solutions, and any other liquid that may be used to carry out a wash/rinse process.

A pressure sensor 28 is provided to measure the liquid pressure at or near the bottom of the wash tub 14. In this example, sensor 28, located near the control panel area of the washing machine, is connected to the tub 14 at a "tap point" 24 located along the side wall of the wash tub 14, adjacent to the bottom of the tub 14. A flexible hose 26 places the pressure sensor 28 in fluid communication with the tap point 24. Preferably, the tap point 24 is configured to develop a pressure head that reflects both static water pressure and water pressure resulting from water movement (e.g., rotation) within the tub 14. Additionally, the hose 26 leading from the tap point 24 to the sensor 28 is preferably an essentially directly vertically oriented hose 26 (no S-bend or dip) to avoid water build-up in the air column that may adversely affect pressure readings.

In general, pressure sensor 28 may operate as follows. As water fills the wash tub 14, a column of air is trapped in the hose 26 between the tap point 24 and a transducer positioned at the pressure sensor 28. As the amount of water in the tub 14 increases, the pressure in the air column increases and presses against the transducer. Unlike the mechanical pressure actuated switches that have conventionally been included in washing machines to provide a means for terminating the water fill upon reaching a fill amount corresponding to a user selected load size, the present invention preferably utilizes a transducer that generates an electrical signal which varies substantially linearly with the pressure of the air column, which in turn varies linearly with the water pressure at tap point 24. While the pressure may be referred to in terms of inches of water, the pressure sensor actually outputs an electrical signal in millivolts (mV), as described further with reference to FIG. 4.

A motor 22, for example, an induction motor with a simple on-off control, is operably connected to the wash basket 16 to rotate (i.e., spin) the basket 16 within the stationary outer wash tub 14 in a conventional fashion. The operation of the motor 22 (e.g., on-off control thereof) is directed by the controller 30 of the washing machine 10. The controller 30 may receive various inputs, including readings from pressure sensor 28 and detected user-selected wash cycle settings (e.g., wash type, size, temperature, fabric type, etc.). Additionally, data indicating the age of the appliance, e.g., in terms of cycles of use to date, may be maintained and input to the controller 30 to account for significant wear-out phenomena. Based on these inputs, a control algorithm, and coefficients included in the control algorithm (which may be determined through regression analyses), the controller 30 coordinates the wash operation cycles, including opening and closing flow control valves to dispense water into the wash tub 14, activating the drainage pump 32 to drain the wash tub 14, and operating the motor 22 and the associated transmission to spin the wash basket 16 and oscillate the agitator 18.

Adaptive fill methodologies in accordance with the invention may advantageously be carried out using a suitably programmed electronic controller controlling the timing and coordination of the operation of the washer components. Thus, many existing washing machine designs may be readily adapted to carry out the inventive fill methodologies, through the provision of a controller 30 programmed or otherwise configured in accordance with the present invention, and an electronic pressure sensor which provides a pressure level indicating output to the controller.

Figure 2:
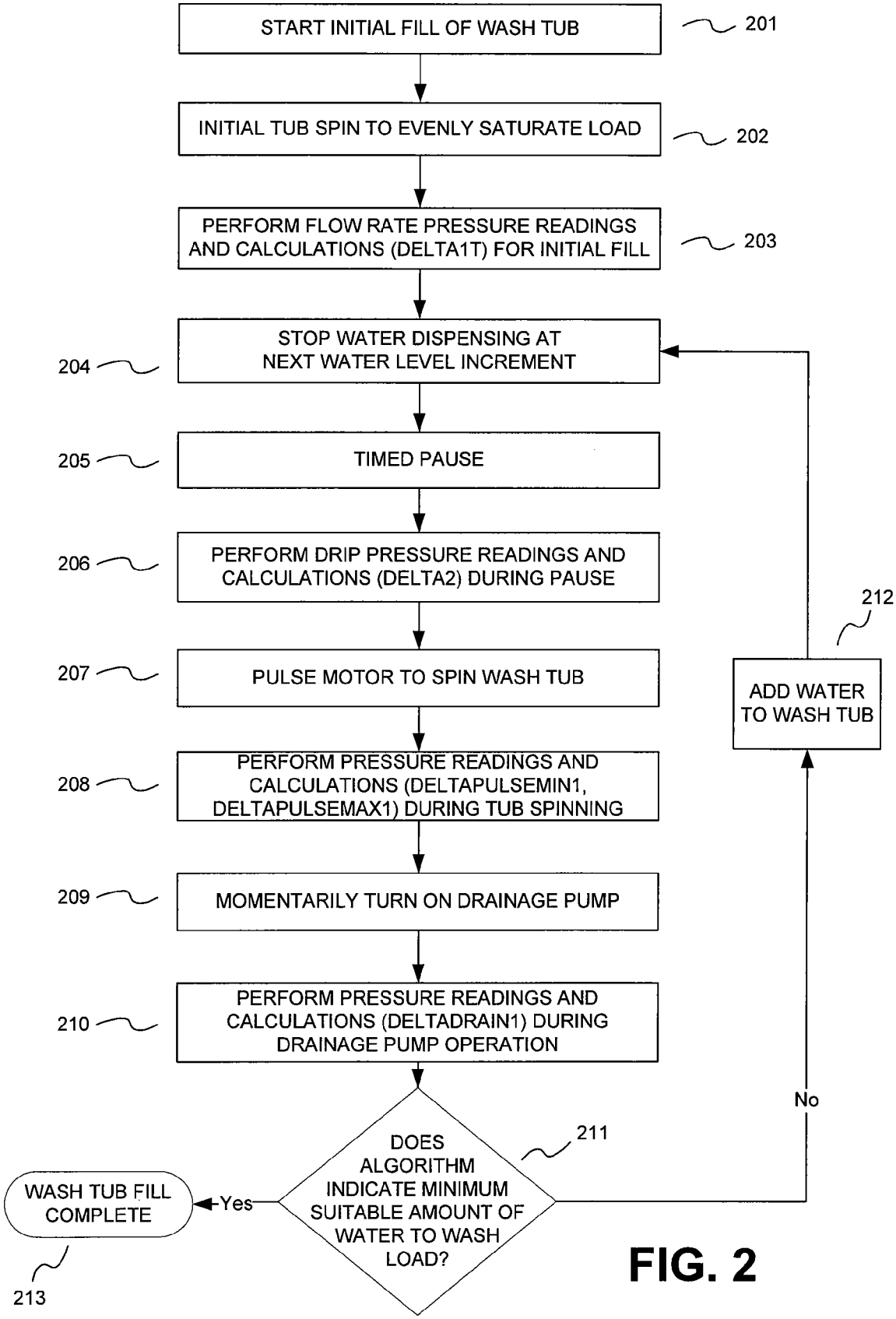
FIG. 2 is a flow diagram illustrating a wash tub fill process in accordance with aspects of the invention.
Figure 3:
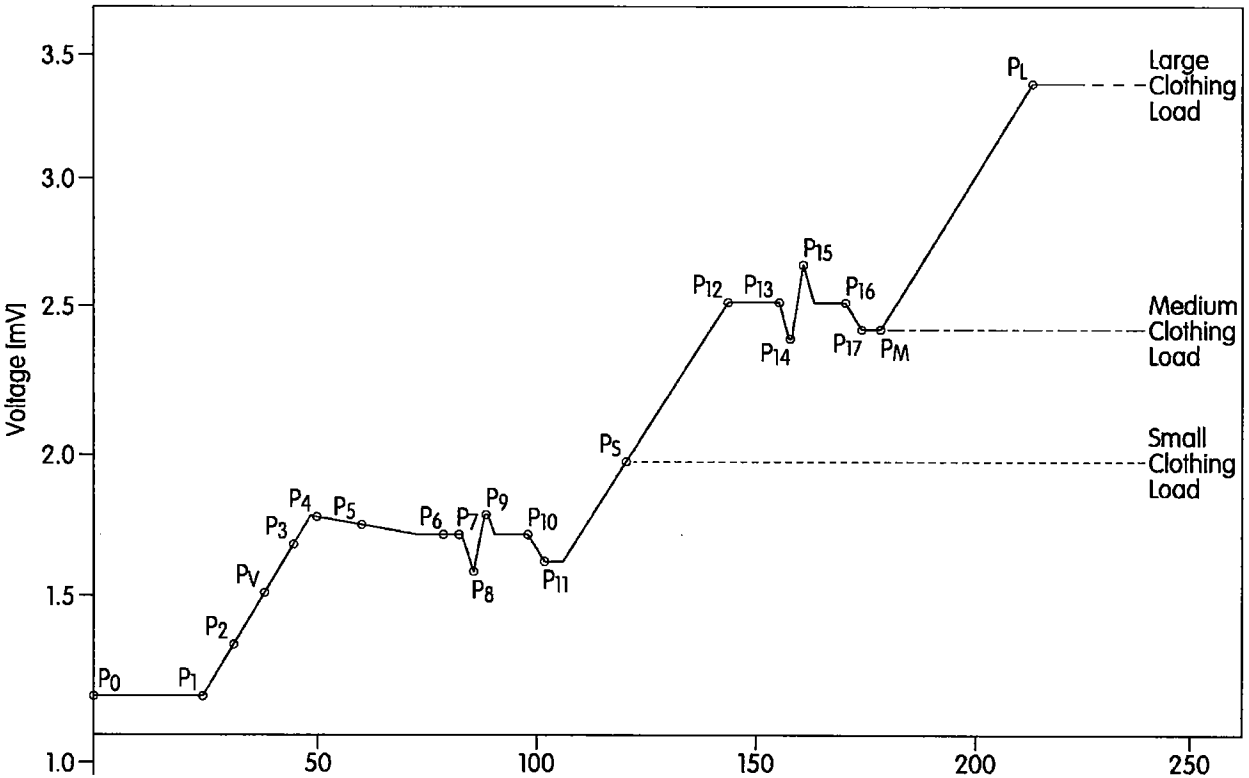
FIG. 3 is an illustrative line graph plotting pressure against time during the process of filling a wash tub illustrated in FIG. 2.

In FIG. 2, a flow diagram illustrates a method for filling a wash tub 14 with a suitable amount of water in accordance with aspects of the invention. The steps shown in FIG. 2 will be discussed with reference to FIG. 3, an illustrative graph plotting pressure sensor output against time during a wash tub fill process in accordance with the invention. In the illustrative graph of FIG. 3, the pressure sensor 28 outputs a voltage reading which varies substantially linearly with the water pressure in the wash tub 14. The pressure sensor output scale (y-axis) shown in the graph of FIG. 3 is in millivolts (mV) and ranges from 0 mV to 3.5 mV, while the time scale (x-axis) ranges from 0 to 250 seconds. Several pressure readings P0-P17, PS, PL, etc., recorded during the water filling process, are labeled on the line graph of FIG. 3.

Throughout the discussion of the flow diagram of FIG. 2, and associated graph of FIG. 3, several different variables are calculated based upon pressure readings taken during the filling process. For ease of reference, these variables, described in detail below, are initially listed in the following table, along with the pressure readings taken to perform the calculation of the variable, and a brief description of what the variable represents.

TABLE 1

| Variable | Readings | Description |
|---|---|---|
| DELTA1T | P2-P3 | Total water flow rate. |
| DELTA1H | P2-PV | Hot water flow rate. |
| DELTA1C | PV-P3 | Cold water flow rate. |
| DELTA2 | P5-P6 | Water level variation during pause. |
| DELTAPULSEMIN1 | P7-P8 | Pressure drop during first basket spin. |
| DELTAPULSEMAX1 | P7-P9 | Pressure rise during first basket spin. |
| DELTADRAIN1 | P10-P11 | Water level variation while drainage pump turned on. |

TABLE 1-continued

| Variable | Readings | Description |
|---|---|---|
| DELTAPULSEMIN2 | P13-P14 | Pressure drop during second basket spin. |
| DELTAPULSEMAX2 | P13-P15 | Pressure rise during second basket spin. |
| DELTADRAIN2 | P16-P17 | Water level variation while drainage pump turned on. |

In step 201, water flows from the water supply 20 to begin an initial fill of the wash tub 14. During the initial fill, the clothes in the basket 16 are wetted, and free water begins to accumulate at the bottom of the tub 14. Besides simply adding water to the tub 14, the initial fill is preferably designed to effectively evenly saturate the clothes at the outset and before a substantial amount of free water collects in the bottom of the wash tub. To aid in this respect, the water supply 20 outlet may comprise a wide spray nozzle and/or multiple spray nozzles positioned about the top of wash tub 14.

The first interval of the graph of FIG. 3, between pressure readings P0 and P1, shows the initial water filling of the tub 14, corresponding to step 201 in FIG. 2. The plot is flat during this interval because the pressure sensor 28 used in this example has a minimum threshold pressure output of about 1.2 mV, which corresponds, e.g., to approximately five inches of free water in the tub 14. Thus, although the liquid pressure at the tap point 24 at the bottom of the tub 14 is actually increasing during this step, the readings from pressure sensor 28 will remain constant until the threshold amount of free water has accumulated in the tub 14, at pressure reading P1.

In step 202, during the initial water fill, the motor 22 may be temporarily energized, or pulsed, one or more times to rotate the wash basket 16 while water is sprayed into the tub 14. Using this motor pulse, the clothes in the basket 16 are sprayed with water from different angles, resulting in a quicker and more even saturation of the clothes above the free water line. The initial motor pulse is shown in FIG. 3, beginning at the point P1. Beginning at this point, since the minimum pressure threshold for sensor 28 has been reached, the voltage output now varies in relation to the amount of free water in the tub 14. At or near point P1, an initial motor pulse, which may last approximately 0.5 seconds, can be used to rotate the wash basket 16 approximately 180 degrees shortly after the tub fill process has begun, so that the load of laundry is wetted evenly by the sprayers of the water supply. Multiple pulses lasting for shorter intervals may be used to produce a similar saturating effect.

In step 203, one or more flow rate calculations are performed during the initial fill. The flow rate refers to the rate at which water from the water supply 20 is entering the wash tub 14. This rate may change over time depending on external factors, such as the volume and pressure of water in the pipes connected to the washing machine 10, and the water temperature and wash cycle selected by the user. A variety of techniques may be used for measuring flow rate. For example, two pressure readings (e.g., P2 and P3 in the graph of FIG. 3) may be taken at two different times while dispensing water into the wash tub 14, to provide a measure of the volume of water in the tub 14 at two different times, and the flow rate (DELTA1T) is calculated based on the change in the readings over the time interval. Examples of other possible flow determination techniques include the use of a flow gauge positioned in the water supply line(s) or tub, and weight or water height measurements over time. Different flow rate measurements may be performed to measure a hot water flow rate, where only the hot water valve is opened during the readings, and a cold water flow rate, where only the cold water valve is opened during the readings. As depicted in FIG. 3, the water flow rates for hot and cold water are measured during the initial flow period, between points P2 and P3 on the graph. The hot water flow rate (DELTA1H) may be determined by comparing the pressure readings at points P2 and PV, during which only the hot water valve is opened. Then, the cold water flow rate (DELTA1C) may then be determined by comparing the pressure readings at points PV and P3, during which only the cold water valve is opened. Of course, in other arrangements the single overall flow rate (DELTA1T) may be relied upon instead.

In step 204, the initial dispensing of water into the wash tub 14 is stopped once it is determined that the amount of free water in the tub 14 has reached a predetermined level (e.g., a target free water volume, or target free water height in the wash tub 14). The first iteration of step 204 corresponds to the pressure reading P4 on the graph of FIG. 3. At this point, the initial tub filling stops when the predetermined pressure threshold (in this case, a sensor output of 1.8 mV) is reached.

As described in steps 205-211 below, at this water level a determination will be made as to whether the amount of free water in the tub 14 is sufficient to wash the load of clothes. The point at which the target water level is reached in step 204 may be determined using pressure readings from the pressure sensor 28. Readings from the sensor 28 are used to determine the volume (or height) of free water in the wash tub 14. Thus, when the controller 30 determines that a certain pressure threshold has been reached, the flow from the water supply 20 is shut off, and the process continues with steps 205-211.

In step 205, after the previous addition of water to the wash tub 14, a predetermined time interval occurs during which the water fill process is paused. One purpose of the pause is to allow the free water in the tub 14 to settle to a generally static state after the filling, making the subsequent pressure readings more consistent and stable. The length of the time required for the water to settle may be relatively short, (e.g., approximately five seconds), and may also depend on factors such as the amount and temperature of the free water in the tub. The settling time corresponds to the period between pressure readings P4 and P5 in the graph of FIG. 3.

Another purpose for the pause relates to a drip measurement (DELTA2) that may be performed in step 206. After the dispensing of water has been stopped in step 204, some of the wetted clothes in the wash basket 16 may still be above the free water line in the wash tub 14. In step 206, the drip measurement DELTA2 is performed as a series of timed liquid pressure readings in the tub 14 to gather information about the wetted clothes above the water line. During the pause in step 205, water may drip or run off of the saturated clothes above the water line, joining the free water pool and thus slightly raising the water level in the tub 14. The timed pressure readings of step 206 are influenced by this change in the free water level in the tub 14, and thus provide information regarding the amount of wetted clothes still above the water line. Also during this pause, air bubbles trapped in articles of the load may escape to the surface, slightly lowering the water level in the tub 14 an amount which bears a relation to the amount of clothing below the water line. Through regression analyses, as described below, it has been determined that the direction and the amount of the pressure change under these circumstances bears a correlation to the load size. Thus, the counteracting nature of the dripping effect and the bubbling effect influences during the timed pause of step 205, yields data relevant to the load size determination.

Further information regarding the amount of clothing above the water line may be obtained using the flow rate data collected in step 203. To the extent that non-saturated clothing remains above the water line, a detected flow rate based on pressure readings within the tub will vary from an actual flow rate from the water supply 20 due to progressive water absorption in the wash load as the water line rises.

In FIG. 3, the drip measurement DELTA2 occurs during the slightly sloped graph section between pressure readings P5 and P6. In this example, the DELTA2 measurement takes place over an approximately 15 second timed period. The pressure readings P5 marks the end of the settling time described above, and the P6 reading is performed at a point near the end of the 20 second pause 205. As evident in the example shown in FIG. 3, the water level during this pause has lowered slightly as a result of the air bubbles released from submerged articles of clothing. This drop (or a similar rise) in the water level is detectable and quantifiable with a pressure sensor having a resolution of 0.01 inches of water height.

In conjunction with steps 205-206, the controller 30, comparing the pressure differences between the two readings, may now make a determination regarding the amount of water necessary to wash the clothes in the basket 16. For example, if the water level decreased substantially between the two readings, the controller 30 may determine that most or all of the articles of clothing in the basket 16 are submerged below the free water line, using a control algorithm and coefficients therefore, determined by regression analysis. In contrast, if the water level increased substantially between the two pressure readings, the controller 30 might determine that most of the wetted articles are still above the water line. This information may be used as the sole factor from which it is determined whether there is a sufficient amount of water in the wash tub 14 for the laundry load. However, in preferred embodiments, this information is just one of several factors used by the controller 30 in making the determination.

In step 207, the motor 22 driving the rotation of the wash basket 16 within the wash tub 14 is "pulsed," i.e., briefly activated or energized. This motor pulse briefly spins the wash basket 16 and the load of clothes, imparting a centrifugal force on both the water and clothing in the basket 16. As described in detail below with reference to FIG. 6, the motor pulse may push an additional amount of free water through the perforations of the wash basket 16 into the wash tub 14, forming a generally parabolic water profile. Additionally, as the wetted clothes are pushed outward against the side walls of the basket 16, they may also affect the movement of water between the wash basket 16 and wash tub 14, and hence the pressure sensed at tap point 24 (FIG. 1).

Figure 6:
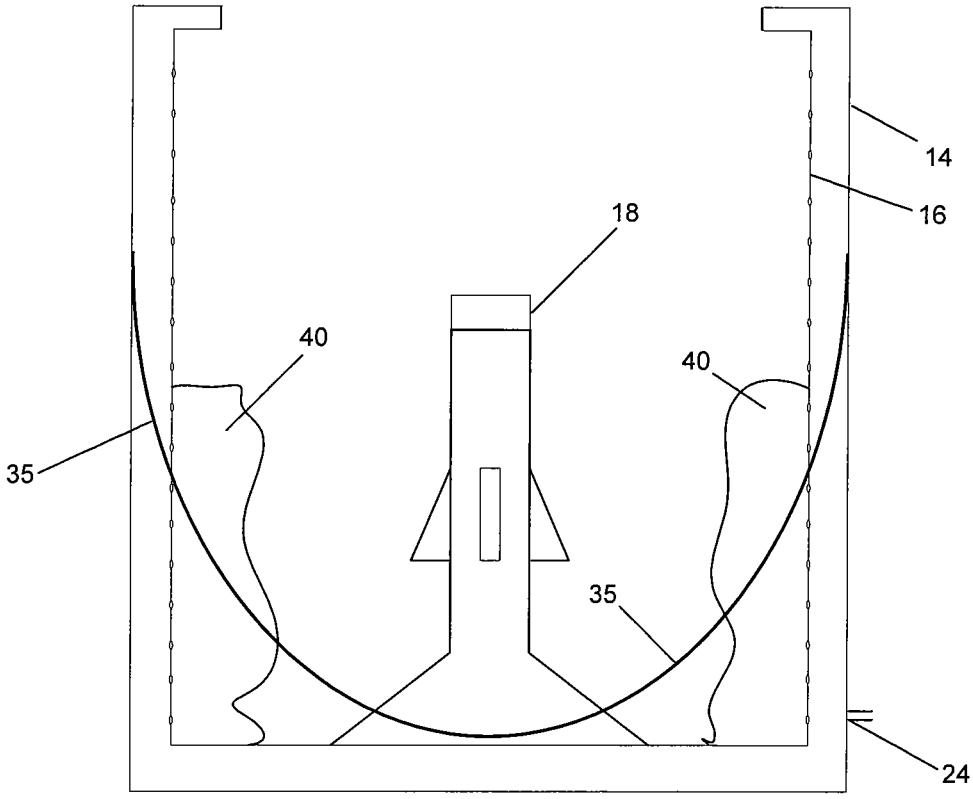
FIG. 6 is a diagrammatic representation of an outer wash tub and nested wash basket illustrating a parabolic water profile generated during an interval of tub spinning in accordance with certain aspects of the invention.

Referring briefly to FIG. 6, an example of a parabolic water profile potentially resulting from the motor pulse of step 207 is shown. In FIG. 6, the wash tub 14, wash basket 16, and agitator 18 are shown in a configuration similar to the washing machine 10 shown in FIG. 1. In FIG. 6, an amount of free water has accumulated in the wash tub 14. As shown by the water line 35, the motor pulse and resultant spinning of the basket 16 imposes an outward force on the free water, forcing the water away from the agitator 18 and the center axis of the basket 16, and toward the side walls of the wash tub 14. The centrifugal force likewise presses the laundry load 40 against the cylindrical walls of wash basket 16. Thus, the cross section of the wash tub 14, either during or shortly after the motor pulse of step 207, typically will approximate a parabolic curve as diagrammatically depicted in FIG. 6.

Referring now to step 208, during and/or shortly after the motor pulse of step 207, one or more pressure readings are taken using the pressure sensor 28. These pressure readings measure the effect of the motor pulse on the free water and clothes in the basket 16, and further enable the controller 30 to determine whether there is a sufficient (suitable minimum) amount of water in the tub 14 for washing the particular load. Specifically, the controller 30 may store the minimum pressure reading during the spinning of the tub 14 and compare this value to the pressure reading in the tub 14 just before the motor pulse. It has been observed that the sensed liquid pressure in the tub 14 may drop during the motor pulse, and that the drop to the minimum pressure during the basket spinning, which may correspond to the very end of the pulse, is correlated to the amount of free water in the tub in relation to the laundry load. It has also been observed that following the motor pulse, while the wash basket 16 is still spinning but decelerating, the pressure readings taken by the sensor 28 may be greater than the pressure readings taken before the pulse. As mentioned above, multiple pressure readings may be taken during these different phases of the motor pulse: before the motor pulse, during the pulse and the associated acceleration of the wash basket 16, shortly after the pulse during the deceleration of the wash basket 16, and after the spinning of the basket 16 has stopped.

The motor pulse of step 207 and pressure sensor readings of step 208 correspond to the graph area of FIG. 3 between points P7 and P9. Pressure reading P7 measures the wash tub pressure at (or just before) the beginning of the motor pulse. Pressure reading P8 may correspond to the minimum pressure reading during the basket spinning which results from the pulse. From these readings, the DELTAPULSEMIN1 may be calculated as the pressure difference between readings P7 and P8. In this example, a 2.5 second motor pulse, as described in step 207, follows the 20 second time delay. Observing the graph of FIG. 3, immediately following the start of the motor pulse, the water pressure in the tub 14 begins to decrease. The pressure readings continue to decrease during the motor pulse and the wash basket 16 continues to accelerate in the wash tub 14. When the motor pulse ends, the water pressure in the tub 14 begins to increase as the basket 16 decelerates and eventually stops. In this example, the P8 pressure reading, the local minimum pressure reading during the motor pulse, occurs at the very end of the pulse, and the DELTAPULSEMIN1 is calculated as the difference in tub pressure as measured just before the motor pulse and at the very end of the motor pulse. Other measurements may be taken during and shortly after the motor pulse of step 207, such as the P9 reading corresponding to the local maximum pressure reading immediately following the motor pulse. DELTAPULSEMAX1 may then be calculated as the difference between the tub pressure P7 measured just before the motor pulse and the local maximum pressure value P9 observed shortly after the motor pulse.

Referring now to step 209, drainage pump 32 may be run for between 3 and 5 seconds to drain a small amount of water (e.g., less than one liter) from the wash tub 14. While, or shortly after, the drainage pump 32 is turned on, the drain measurement (DELTADRAIN1) may be performed in step 210. The drain measurement DELTADRAIN1, corresponding to the amount of wash liquid drained during the brief running of the drainage pump 32, is calculated as the difference between pressure readings P10 and P11 in FIG. 3. As with the other measurements described above, DELTAD- RAIN1 may be used as a factor in determining whether there is a sufficient amount of water in the wash tub 14 for the laundry load. The following explains how this can be a useful indicator.

The drainage path may extend from a drain inlet located on or near the outer wall of the wash tub 14, such that pump 32 pumps water out from the region between the wash tub 14 and nested wash basket 16. As water is evacuated from this region in step 210, free water in the wash basket 16 will flow through the perforations in the wash basket 16 to fill the voide created. The nature and extent of this flow will vary in relation to the amount of free water and the relative size of the load. A pressure drop at the sensor will occur if the water drained from the tub flows out at a higher rate than free water flows in between wash tub 14 and wash basket 16 to replace it. Thus, if the DELTADRAIN1 measures a large drop in the wash tub pressure, this may indicate that the wash basket contains a relatively small amount of free water relative to the load size, and that an additional amount of free water may be needed to effectively wash the laundry load. To the extent that the pressure drop is smaller or non-existent, this is an indication that there may be a sufficient amount of free water in the tub for the particular load.

Referring now to step 211, the controller 30 performs calculations to determine whether there is a suitable minimum amount of water in the wash tub 14 for washing the current load of clothes. The controller 30 may use all or a selected subset of the different measurements described in the steps above to make this determination. For example, the DELTA2 drip measurement performed in step 206, the DELTAPULSEMAX1 and DELTAPULSEMIN1 measurements performed in step 208, and the DELTADRAIN1 measurement performed in step 210 might be used as variables in an algorithm executed by the controller 30. Accordingly, the determination of step 211 may involve the following logic performed at the controller 30:

Equation 1

```
SET A1 = C1
    + C2 * DELTA2
    + C3 * DELTAPULSEMIN1
    + C4 * DELTAPULSEMAX1
    + C5 * DELTADRAIN1
IF A1 < C6 THEN LOAD SIZE = SMALL
ELSE GOTO EQUATION 2
```

In Equation 1, the values C1-C6 represent constant coefficients stored at the controller 30, which may be determined through regression analyses on the washer 10. To perform such a regression analysis, several test laundry loads may be washed during the design and manufacturing stages of the washer 10. Each test load may have unique predetermined size, fabric type(s), and other associated characteristics. Then, during the wash cycle for a test load, the different pressure readings and calculations described above are performed, and a load size determination is performed in step 211 using Equation 1. For this initial load size determination, the coefficients C1-C6 are assigned an initial default set of values. After performing the initial load size determination using Equation 1, the accuracy of the determination is evaluated based on the known load size, and some or all of the coefficients C1-C6 are adjusted based on this evaluation. As is well known in statistical analyses, many iterations of an experiment with certain known factors, along with continuous adjustment of the unknown variables based on the success rate, can eventually "solve" for the unknown variables. Thus, a regression analysis can be performed to determine suitable values for the coefficients C1-C6 for the tested washer 10. These coefficients C1-C6 may then be hard-coded into Equation 1 in the controller 30 of that washer 10, allowing the controller to make accurate load size determinations for subsequent laundry loads. Thus, although different washers may have different physical characteristics (e.g., tub size, tub shape, motor force, basket perforation pattern, etc.), which may lead to different values for their respective coefficients C1-C6, the same regression analysis approach may be used for the different washers to find suitable coefficients C1-C6 for Equation 1 for use in load size determinations.

Other factors such as the temperature of the water and the fabric type and/or selected wash cycle (e.g., Normal, Delicates, Heavy Duty, etc.) may also be used in the load size determination of step 211. To incorporate these and other factors, a distinct set of coefficients C1-C6 may be generated for each possible combination of the user-selected temperature setting, fabric type, and wash cycle, and a look-up table of the sets of coefficients may be stored in the controller 30 and referred to before applying Equation 1 in a load size determination. To generate a look-up table of multiple coefficient sets, the initial set of coefficients C1-C6 may first be determined through a regression analysis as described above. Then, the subsequent sets of coefficients corresponding to different combinations of user settings may be generated by weighting the initial coefficients C1-C6 appropriately. For example, it may be desirable to configure the controller 30 so that when the user indicates a 'Delicates' wash cycle on the control panel of the washer 10, there is a slightly increased likelihood that the load size determination of step 211 will determine that the load size is not small, i.e., is medium or large, so that a relatively larger amount of water is dispensed into the wash tub. Accordingly, the sets of coefficients in the look-up table corresponding to a user-selected delicates wash cycle may be slightly weighted so that A1 is more likely to be greater than or equal to C6 in Equation 1 above, for example, by increasing the values of one or more of C1-C5, or by decreasing the C6 value in those coefficient sets.

As an alternative to the load determination process described above, only a few or even just a single measurement may be used by the controller 30 in making the determination at step 211, albeit perhaps with less accuracy. For example, the controller 30 might determine the sufficiency of the current amount of free water in the tub 14 solely by using the DELTA2 drip measurement performed in step 206. In this case, the pulse of step 207 and pressure readings taken in steps 203, 208, and 210 would not need to be taken. As another example, the controller 30 may make the water level determination based solely on the motor pulse and DELTAPULSEMIN1 pulse measurement taken in steps 207-208. Based on some or all of the input variables, a control algorithm and coefficients included in the control algorithm (which may be determined through regression analyses), the controller coordinates the wash operation cycles, including opening and closing flow control valves to dispense water into the wash tub 14.

If the controller 30 determines in step 211 that the wash tub 14 contains a sufficient suitable minimum amount of free water for washing the load of clothes (211:Yes), control continues to step 213 and the washer fill process is completed for this wash cycle. However, if the controller 30 determines in step 211 that the wash tub 14 does not contain enough free water to wash the clothes (211:No), an additional amount of water is added to the wash tub 14 in step 212, before returning control to step 204 for repeating the actions and readings of steps 204-211. The amount of water added in step 212 can be determined as a predetermined volume based on measured flow rates DELTA1H and DELTA1C, or may correspond to a predetermined pressure reading representing the next water level iteration for the washing machine 10. For example, if the washing machine 10 has a predetermined water pressure reading associated with the 'Small' load size (e.g., pressure reading PS in FIG. 3) and a different predetermined water pressure reading associated with the 'Medium' load size, then after a 211:No determination at a 'Small' water level, water can simply be added until the 'Medium' reading is detected by the pressure sensor 28. Alternatively, the amount of water to be added in the next fill interval may be determined dynamically by the controller 30 during step 211. For example, if the controller 30 implementing the control algorithm determines based on the various measurements that the current water level is far below the amount needed to the wash the load of clothes, the controller 30 may add an extra amount of water or skip one or more water level iterations in order to save the time and energy of performing additional rounds of motor pulses and pressure readings.

The graph section of FIG. 3 between pressure readings P11 and P12 indicates that in this example, the determination has been made in step 211 that the current laundry load is not a small load, and thus that additional wash liquid should be added to the tub 14 and the water fill should not be stopped at the small load level pressure PS. Thus, in this graph section of FIG. 3, the water supply valve(s) 20 are opened to continue filling the tub 14 up to or just above the 'Medium' load size level, and are finally closed at pressure reading P12. Of course, if it is determined in step 211 that the current laundry load is a small load, then water is added to the tub 14 only until the small load level PS, then the filling process stops and is completed at step 213. As described above, this determination may be based on one or more of the DELTA1T, DELTAH1, DELTAC1, DELTA2, and DELTAPULSEMIN1, DELTAPULSEMAX1, and DELTADRAIN1 measurements taken in the previous steps, as well as other factors.

Pressure reading P12 on the graph of FIG. 3 corresponds to the second iteration of step 204, where once again the water dispensing in the wash tub 14 is stopped to take additional readings. In this example, the water dispensing is stopped at a pressure reading of 3.14 mV, corresponding approximately to the 'Medium' wash load size water level for washing machine 10.

The short relatively flat section of the graph between readings P12 and P13 in FIG. 3 corresponds to the second iteration of step 205. Unlike the 20 second pause shown early in FIG. 3, this shorter pause might not involve a second drip measurement. Thus, in this example, the drip measurement is only performed during the first iteration 206. This short pause (e.g., 5 seconds) is simply to allow the free water in the tub 14 to settle before performing the next motor pulse and pressure readings, to improve the accuracy and consistency of the subsequent readings.

In the graph area of FIG. 3 between pressure readings P13 and P14, the washer motor 22 is energized with another short motor pulse (e.g., 2.5 seconds) following the 5 second pause. As with the first motor pulse during readings P7-P8 in the graph of FIG. 3, the water pressure recorded at tap point 24 by the pressure sensor 28 decreases during the motor pulse to a local minimum (P14), and then increases immediately following the pulse to a local maximum (P15). A second set of pulse pressure readings, DELTAPULSEMIN2 and DELTAPULSEMAX2, may also be taken during the second pulse, corresponding to the pressure differences in the P13-P14 and P14-P15 intervals, respectively. This second motor pulse and pulse measurements DELTAPULSEMIN2 and DELTAPULSEMAX2 correspond to the second iteration of steps 207-208 in FIG. 2. It should be noted that the set of measurements performed in different iterations of the measuring steps may be different. That is, although both a minimum (DELTAPULSEMIN2) and maximum (DELTAPULSEMAX2) pulse pressure readings are taken in the graph of FIG. 3, in certain other embodiments, one or both of these readings need not taken or used in a step 211 determination. For example, in the second iteration of steps 207-208, only the DELTAPULSEMIN2 calculation might be performed, in which case the pressure readings used for the DELTAPULSEMAX2 calculation need not be taken.

After the second motor pulse and associated pressure readings are taken, as shown in the graph of FIG. 3, the drainage pump 32 once again may be temporarily engaged to drain a small amount of wash liquid from the wash tub 14. A second drain measurement (DELTADRAIN2) may be calculated shortly after the drainage pump 32 is stopped, as the pressure difference between P16 and P17 in the graph of FIG. 3. The second activation of the drainage pump 32 and the DELTADRAIN2 measurement correspond to the second iteration of steps 209 and 210 in FIG. 2.

Shortly after the drainage pump 32 is turned off at point P17 of FIG. 3, a second determination is made, corresponding to the second iteration of step 211, whether there is a suitable minimum amount of free water in the tub 14 to wash the load. In this determination, the previous measurements DELTA2, DELTAPULSEMIN1, DELTAPULSEMAX1, and DELTADRAIN1 may be used by the controller 30, along with the more recent measurements, DELTAPULSEMIN2, DELTAPULSEMAX2, and DELTADRAIN2. Accordingly, the determination of step 211 may involve the following logic performed at the controller 30:

Equation 2

```
SET A2 = C7
    + C8 * DELTA2
    + C9 * DELTAPULSEMIN1
    + C10 * DELTAPULSEMAX1
    + C11 * DELTAPULSEMAX2
    + C12 * DELTAPULSEMIN2
    + C13 * DELTADRAIN1
    + C14 * DELTADRAIN1
IF A2 < C15 THEN LOAD SIZE = MEDIUM
ELSE LOAD SIZE = LARGE
```

Similar to the coefficients used in Equation 1, the coefficients C7-C15 of Equation 2 may be determined through regression analyses on the washer 10. As described above, while the actual coefficient values may vary from one model of washer to the next, the equations themselves used for the load size determinations may stay constant. Additionally, once a regression analysis has been performed on a test group of washers of a certain model to determine suitable values for the coefficients C1-C15, these coefficient values may be assumed to be approximately the same for every washer of that model, and may therefore be hard-coded into the controller logic of those washers during the manufacturing process.

As shown in the graph of FIG. 3, it is once again determined that an additional amount of water should be added to the tub 14 for washing the load. Accordingly, one or both of the water flow control valves are opened to continue filling the tub 14 up to the 'Large' wash load size level. In one embodiment, 'Large' is the highest of only three possible load size settings in washing machine 10, so there is no need to perform any additional measurements after determining that the 'Medium' water level is insufficient for washing the load. Thus, following the second determination in step 211, the tub 14 is filled for the amount of time necessary to reach the 'Large' setting level, and the wash tub fill process is complete.

It should be noted that an additional set of flow rate measurements may be performed during the time fill of the wash tub 14 to reach the next load size setting. For example, in FIG. 3 even though it is determined shortly after point P17 that the tub 14 should be filled up to the 'Large' setting level, additional flow rate measurements may still be performed to ensure that a the tub 14 is filled for the proper amount of time to reach the 'Large' level. Similar flow rate measurements may be taken while the wash tub 14 is being filled up to the 'Small' level, or during the fill in between the 'Small' and 'Medium' levels. These additional flow rate measurements may be useful for determining the stopping point for a timed water fill, since the hot and/or cold flow rates may change during the wash cycle for any number of reasons (e.g., change in pressure/flow rate at the water supply). The additional flow rate calculations may also be used in the subsequent determinations performed in step 211, as replacements or in addition to the DELTA1T, DELTA1H, and DELTA1C flow rate measurements.

The determination of load size need only be made once in the process of washing a given load of laundry. For example, during a subsequent wash tub fill, for one or more rinse cycles following the wash cycle, the previous determination of load size obtained through use of the inventive process may be reapplied. However, during a rinse cycle, the washer 10 could perform one or more additional flow rate calculations (e.g., DELTA2T, DELTA2H, DELTA2C) to determine and monitor the overall flow rate and/or hot and cold water flow rates during a wash tub fill during the rinse cycle. In order to more accurately determine a fill cutoff time, the flow rate calculations during the rinse may be made more than once (e.g., every 30 seconds) during the rinse cycle time fill.

Figure 4:
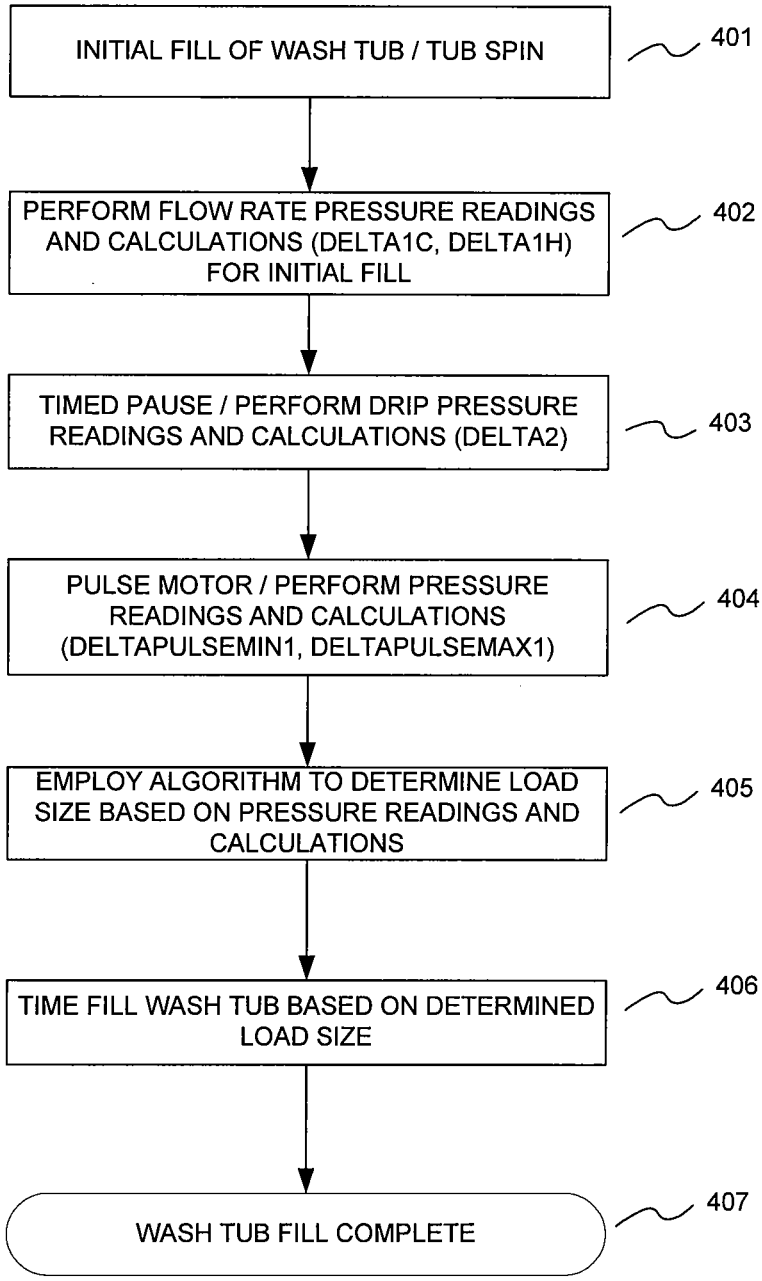
FIG. 4 is a flow diagram illustrating another wash tub fill process in accordance with aspects of the invention.
Figure 5:
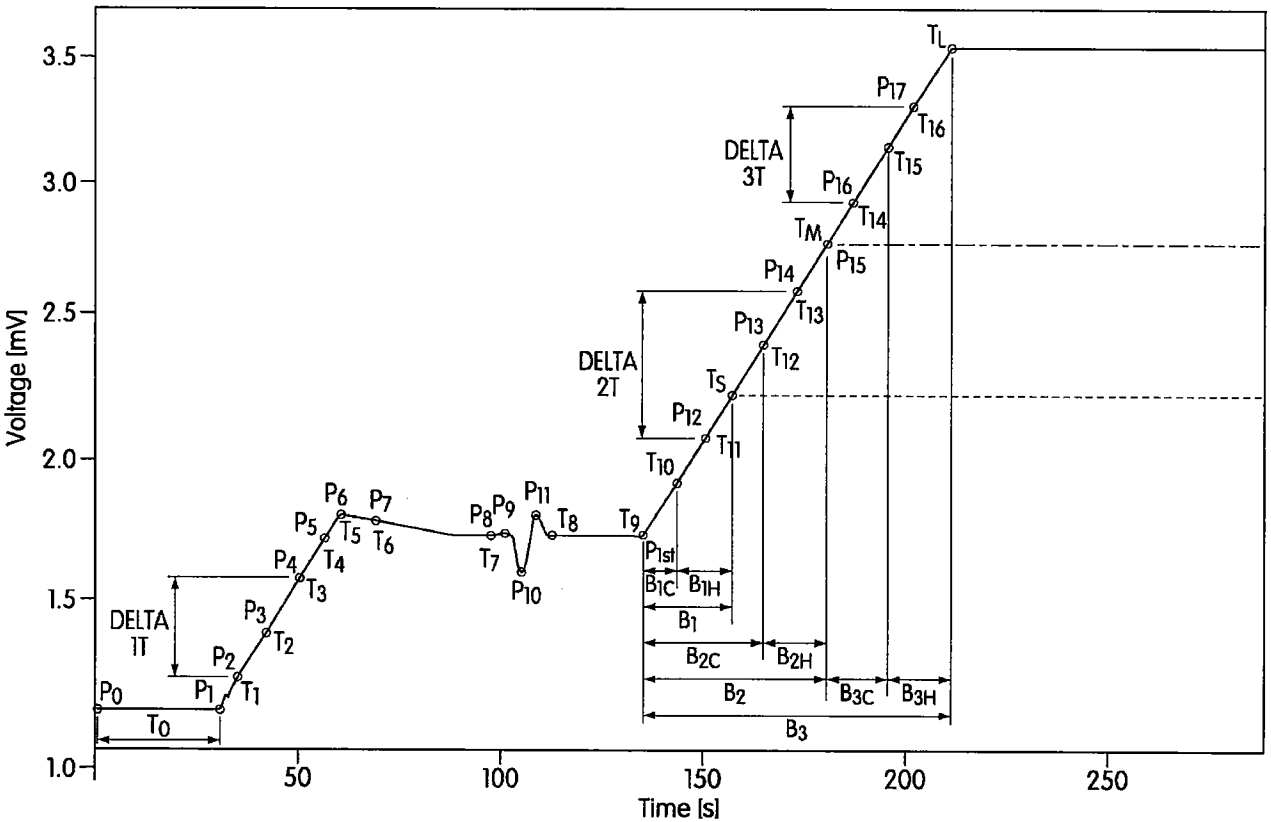
FIG. 5 is an illustrative line graph plotting pressure against time during the process of filling a wash tub illustrated in FIG. 4.

In FIG. 4, a second flow diagram is shown illustrating another adaptive method for filling a wash tub 14 with an amount of water suitable for the load, in accordance with aspects of the invention. The steps shown in FIG. 4 will be discussed with reference to FIG. 5, a second illustrative graph plotting pressure sensor output against time during a wash tub fill process. In the illustrative graph of FIG. 5, as in the graph of FIG. 3, the pressure sensor 28 outputs a voltage reading that varies with the water pressure in the wash tub 14. In FIG. 5, the pressure sensor output scale (y-axis) ranges from 0 mV to 3.5 mV, while the time scale (x-axis) ranges from 0 to 250 seconds. Similarly, several pressure readings, P1-P17, are recorded during the water filling process.

In step 401, the initial fill of the wash tub 14, and initial tub spin are performed. This step is similar to steps 201-202 described in reference to FIGS. 2-3. In step 402, one or more flow rate pressure readings and calculations are performed, similar to those described in step 203. As mentioned above, separate flow rates may be calculated for the water flow from the hot and cold supply valves (e.g., DELTA1H and DELTA1C). Alternatively, a single flow rate corresponding to the total water flow into the wash tub 14, e.g., DELTA1T, may be used instead of separate hot and cold flow rates. In step 403, a timed pause and drip measurement (e.g., DELTA2) is calculated, using measurements similar to those described in steps 205-206. In step 404, a short motor pulse and one or more pulse pressure measurements (e.g., DELTAPULSEMIN1, DELTAPULSEMAX1) are calculated, using techniques such as those described in steps 207-208. As described above, the present invention need not use every measurement described to make the determination of the suitable amount of water in the tub 14. For example, the embodiment of FIGS. 4-5 does not include steps corresponding to the running of the drainage pump 32 or a drain measurement calculation such as DELTADRAIN1 or DELTADRAIN2. Thus, in this example, the determination of the suitable amount of water for the load is not based on any drain measurements, but may instead be based on the combination of flow rate measurements, drip measurements, and motor pulse measurements performed in steps 402, 403, and 404, respectively.

In step 405, the controller 30 performs calculations to determine the size of the laundry load currently in the wash basket 16. However, in this example, the proper load level setting is always determined after a single iteration of measurements. In other words, the first iteration of step 211 only determines whether or not the current load is small, and if it is not, future measurements will be performed to determine the precise load size (e.g., 'Medium' or 'Large'). In contrast, the determination in step 405 will make a final conclusion regarding the proper load size (e.g., 'Small', 'Medium', or 'Large') based solely on the measurements performed in steps 402-404. Thus, in this example, no future calculations or load size determinations are necessary. Accordingly, the determination of step 405 may involve implementation of the following logic at the controller 30:

Equation 3

```
SET A1 = C1
    + C2 * DELTA1T
    + C3 * DELTA2
    + C4 * DELTAPULSEMIN1
    + C5 * DELTAPULSEMAX1
IF A1 < C6 THEN LOAD SIZE = SMALL
ELSE IF A1 > C6 AND A1 < C7 THEN LOAD SIZE = MEDIUM
ELSE IF A1 > C7 THEN LOAD SIZE = LARGE
```

As shown in FIG. 5, it is determined at step 405 (e.g., by execution of the logic of Equation 3 by the controller 30, using coefficients C1-C7 determined through regression analyses on the washer 10), that the current load size is 'Large' and the tub should be filled up to the 'Large' level. Accordingly, the water fill need not be stopped at the 'Medium' level, as it was in illustrative method of FIGS. 2-3, but may continue directly to the 'Large' level, as is shown in the graph of FIG. 5.

In FIG. 5, the washer fill example shown includes only a single load size determination, occurring at around the time T8. Thus, after time T8, it has been determined whether the current load is a small, medium, or large load, and no further determination of load size will be made. When the timed water fill begins at point T9, the overall flow rate DELTA1T may be used to determine the amount of time that the valves for the hose(s) of the water supply 20 should remain open to add the appropriate amount of water into the wash tub 14 for the current load. For example, if the load is determined to be a small load, then the flow rate DELTA1T may be used to calculate a target time TS for adding water into the tub 14. If the load is a medium or large load, then the target time TM or TL may be calculated based on the load size and the flow rate DELTA1T. Of course, separate flow rates for different water hoses (e.g., hot and cold) in the water supply 20 may be used as well. Either way, once the target time is calculated, the flow control valve(s) of water supply 20 are opened for the calculated amount of time (e.g. B1, B2, or B3), to add an amount of water into the wash tub 14 which is appropriate for the current load size.

Alternatively, the timed water fill may be divided into a cold water fill and separate hot water fill, from the cold and hot water hoses of the water supply 20. By dividing the timed water fill into separate cold and hot fill times (e.g. B1C, B1H, B2C . . . ), the temperature of the water in the tub 14 may be more precisely controlled. For example, the small load fill time B1 may be divided into a short cold water fill time B1C followed by a longer hot water fill time B1H, based on the known temperatures of the cold and hot water sources, and the desired (e.g., user-selected) wash temperature. Thus, time T10 may be calculated as the point at which the cold water valve is closed and the hot water valve is open, or vice versa, to achieve a desired temperature for the water in the wash tub 14 at the small load target time TS.

Additional flow rate measurements may also be performed during the timed water fill, so that the load size-based target fill times (e.g., TS, TM, and TL) may be adjusted to account for any changes in the flow rate(s) since the initial flow rate measurement (DELTA1T in FIG. 5) performed in step 402. In this example, if the load is determined to be a medium or large load, then a second flow rate calculation, DELTA2T, is performed between two fixed pressure values, P12 and P14. If the calculated DELTA2T flow rate differs from the initial DELTA1T flow rate, then the target fill time (e.g., TM or TL) may be adjusted on the fly during the timed water fill. Similarly, during a timed water fill for a large load, a third flow rate measurement DELTA3T may be performed, and the target time TL may be adjusted based on a change in the water flow rate between the DELTA2T and DELTA3T measurements. In the example shown in FIG. 5, the overall flow rate calculations (e.g., DELTA2T, DELTA3T) are performed during continuous water fills (e.g., B2 and B3), and would not be performed when separate hot and cold water fills (e.g., B2C, B2H, B3C, and B3H) occur. When using separate (e.g., non-continuous) hot and cold fill intervals for temperature control, additional flow rate measurements may be performed during the water fill process. For example, a cold water flow rate and a hot water flow rate may be calculated separately, then both used to adjust the target fill time (e.g. TS, TM, or TL) and to determine a valve switching point (e.g., T10, T12, and/or T15).

The present invention has been described in terms of preferred and exemplary embodiments thereof. Numerous other embodiments, modifications and variations within the scope and spirit of the appended claims will occur to persons of ordinary skill in the art from a review of this disclosure.

The invention claimed is:

1. An automated method for obtaining a level of wash liquid in a wash tub of an automatic washing machine, comprising the steps of:

(a) adding wash liquid into a wash tub;

(b) rotating a wash basket in the wash tub;

(c) detecting a first liquid pressure within the wash tub during the rotation of the wash basket to provide an indication of load size;

(d) determining a target value representative of a target amount of wash liquid in the wash tub corresponding to an indicated load size, based at least in part on the detected first liquid pressure, and determining if that target value has been reached; and (e) adding more wash liquid to the wash tub if it is determined in step (d) that the target value has not been reached;

wherein:

the method further comprises providing an interval of draining wash liquid from the wash tub, detecting liquid pressures within the wash tub before and after said interval, and determining a difference of the detected liquid pressures to provide a further indication of load size; and the determining a target value in step (d) is carried out based in further part on the determined difference of the detected liquid pressures before and after said interval of draining.

2. The method of claim 1, wherein the amounts of wash liquid added to the wash tub in steps (a) and (e) are predetermined.

3. The method of claim 1, wherein the determining a target value step is carried out based in part on a user-selected wash temperature.

4. The method of claim 1, wherein the determining a target value step is carried out based in part on a user-selected wash cycle setting.

5. The method of claim 1, wherein the determining a target value step is carried out based in part on a flow rate for adding wash liquid into the wash tub.

6. The method of claim 1, wherein a pause follows the addition of wash liquid to the tub and precedes the rotation of the wash basket, to allow the liquid in the tub to settle before said rotation.

7. The method of claim 1, wherein in the event the target value determined in step (d) is above a predetermined value, steps (b) through (e) are repeated following step (e).

8. The method of claim 1, further comprising detecting a second liquid pressure within the wash tub before the rotation of the wash basket, and wherein the determining a target value step comprises calculating a difference between the detected first and second liquid pressures.

9. The method of claim 8, wherein the detected first liquid pressure is a minimum pressure occurring during the rotation of the wash basket.

10. The method of claim 8, wherein the detected first liquid pressure is a maximum pressure occurring during the rotation of the wash basket.

11. The method of claim 1, wherein the automatic washing machine is a top load washing machine, and the rotation of the wash basket is about a generally vertical central axis of the wash basket.

12. The method of claim 1, wherein said rotation of the wash basket is such as to form a generally parabolic profile of wash liquid added to the wash tub.

* * * * *